United States Patent [19]

Herrington

[11] Patent Number: 5,070,583

[45] **Date of Patent: * Dec. 10, 1991**

[54] GULL WING ZIPPER SLIDER

[75] Inventor: Fox J. Herrington, Holcomb, N.Y.

[73] Assignee: Mobil Oil Corporation, Fairfax, Va.

[ * ] Notice: The portion of the term of this patent subsequent to Apr. 30, 2008 has been disclaimed.

[21] Appl. No.: 490,106

[22] Filed: Mar. 7, 1990

[51] Int. Cl.[5] ..... A44B 19/16

[52] U.S. Cl. ..... 24/400; 24/430

[58] Field of Search ..... 24/399, 400, 389, 587, 24/430; 156/66; 383/64, 69

[56] References Cited

U.S. PATENT DOCUMENTS

| | | | |
|---|---|---|---|
| 3,103,049 | 9/1963 | Hawlez | 24/400 |
| 3,122,807 | 3/1964 | Ausnit | 24/399 |
| 3,220,076 | 11/1965 | Ausnit et al. . | |
| 3,347,298 | 10/1967 | Ausnit et al. . | |
| 3,426,396 | 2/1969 | Laguerre . | |
| 3,462,332 | 8/1969 | Goto . | |
| 3,579,747 | 5/1971 | Hawley | 24/400 |
| 3,660,875 | 5/1972 | Gutman . | |
| 3,713,923 | 1/1973 | Laguerre . | |
| 3,790,992 | 2/1974 | Herz . | |
| 3,806,998 | 4/1974 | Laguerre . | |
| 4,736,451 | 4/1988 | Ausnit . | |

FOREIGN PATENT DOCUMENTS

| | | | |
|---|---|---|---|
| 375235 | 1/1940 | Italy | 24/400 |

*Primary Examiner*—James R. Brittain

*Attorney, Agent, or Firm*—Alexander J. McKillop; Charles J. Speciale

[57] ABSTRACT

A foldable plastic slider having a pair of hinged wings that fold downwardly and secured permanently in place to the opposite sides of the slider body to attach it to the plastic reclosable fastener elements when manufacturing a thermoplastic bag. The wings are hinged at the top of the slider body to provide for ease in molding the slider using a simple 2-piece mold.

9 Claims, 5 Drawing Sheets

GULL WING ZIPPER SLIDER

BACKGROUND OF THE INVENTION

The present invention relates to improvements in plastic sliders for opening and closing plastic reclosable fasteners on plastic bags and the like and particularly to improvements in "gull wing" type foldable plastic sliders for profiled plastic reclosable fasteners on plastic bags.

Zippers with sliders are made commercially in several forms. The most common ones used on clothing have teeth which interlock. The teeth may be made of metal or plastic. Other types of plastic zippers have profiles and include a pair of male and female fastener elements in the form of reclosable interlocking rib and groove elements with a slider for opening and closing the rib and groove elements. In the manufacture of thermoplastic film bags, a pair of these male and female fastener elements extend along the mouth of the bag and these male and female elements are adapted to be secured in any suitable manner to the flexible walls of the thermoplastic film bag. These elements may be integral marginal portions of such walls or they may be extruded separately and thereafter attached to the walls along the mouth of the bag. A method of continuously providing such a fastener on the thermoplastic film is disclosed in U.S. Pat. No. 3,462,332.

The sliders for opening or closing the reclosable fasteners are essentially U-shaped and adapted to be assembled with the fastener or zipper by an endwise assembly or by a relative transverse maneuver. Where the assembly is performed by a relative transverse maneuver the slider is normally molded from a semi-hard plastic where there is enough yieldability in the side walls of the slider to provide sufficient flexibility to enable spreading apart of the terminal portions of the side walls of the slider so as to clear the interlocking rib and groove elements to permit assembly of the slider with the zipper by relative transverse movement. Where the slider is formed from a metal die casting or a hard plastic, it is then necessary to rely upon the plastic deformation of the plastic zipper elements to permit the transverse assembly movement of the slider. Such assembly can cause damage to the interlocking rib and groove elements during assembly and leaves something to be desired. Examples of assembly of the sliders with plastic reclosable fasteners are disclosed in U.S. Pat. Nos. 3,426,396, 3,660,875, 3,713,923, 3,790,992 and 3,806,998.

RELATED APPLICATIONS

The present invention is an improvement on the foldable plastic slider for a plastic reclosable fastener disclosed in the related application of F.J. Herrington and A. Goncarovs entitled "Foldable Plastic Slider and Method of Assembly with a Plastic Reclosable Fastener" Ser. No. 490,109 filed concurrently herewith and incorporated herein by reference thereto. A method of assembling a metal slider with a plastic reclosable fastener is disclosed in my related application entitled "Method of Assembling a Metal Slider with a Plastic Reclosable Fastener" Ser. No. 490,114 filed concurrently herewith and incorporated herein by reference thereto. Metal sliders as distinguished from plastic sliders have the disadvantage that they are not suitable for use on thermoplastic bags when the bags are to be placed in microwave ovens when heating food products. A method of assembling a multi-part plastic slider with a plastic reclosable fastener is disclosed in my related application entitled "Method of Assembling a Snapped Together Multi-Part Plastic Slider with a Plastic Reclosable Fastener" Ser. No. 490,107, now U.S. Pat. No. 5,007,142 filed concurrently herewith and incorporated herein by reference thereto. Another method of assembling a multi-part plastic slider with a plastic reclosable fastener is disclosed in my related application entitled "Method of Assembling a Multi-Part Plastic Slider with a Plastic Reclosable Fastener by Ultrasonic Welding" Ser. No. 490,109 filed concurrently herewith and incorporated herein by reference thereto. A plastic leakproof zipper with slider is disclosed in the related application of F.J. Herrington and E.A. St. Phillips entitled "Leakproof Zipper with Slider" Ser. No. 490,112, now U.S. Pat. No. 5,020,194 filed concurrently herewith and incorporated herein by reference thereto. Another plastic zipper and slider is disclosed in my related application entitled "Rolling Action Zipper Profile and Slider Therefor" Ser. No. 490,110, now U.S. Pat. No. 5,007,143 filed concurrently herewith and incorporated herein by reference thereto. All of the above-identified related applications are assigned to the same assignee as the present application.

SUMMARY OF THE INVENTION

It is an object of the present invention to provide a new and improved foldable plastic zipper slider and method of assembling the same with a profile plastic reclosable fastener without deforming the fastener during assembly of the slider therewith.

The present invention relates to a foldable plastic slider for straddling relation with a profiled plastic reclosable fastener particularly suited for thermoplastic bags and the like formed by a pair of flexible plastic sheets having a top edge with separable fastening means extending along the length thereof comprising reclosable interlocking male and female elements having rib and groove profiles on the respective sheets. The straddling slider for closing or opening the reclosable fastening elements comprises a wedge-shaped separator finger and interlocking complimentary structure formed from plastic for moving along the fastener. The complimentary structure comprises a transverse support member having the wedge-shaped separator finger depending therefrom, a pair of side walls hinged to the opposite sides of the support member at the top thereof and foldable relative to the separator finger and means for interlocking the opposite sides of the support member to the side walls. The side walls extend from an opening end of the slider to a closing end, the side walls being spaced wider apart at the opening end to permit separation of the rib and groove elements by the wedge-shaped separator finger extending between the side walls at the opening end, the walls being spaced sufficiently close together at the closing end to press the rib and groove elements into interlocking relationship as the slider is moved in a fastener closing direction, at least one of the separator finger and the side walls having shoulder structure at the bottom thereof for cooperating with the bottom of the fastener to prevent the slider from being lifted off the top edge of the fastener while the slider straddles the fastener. In one aspect of the invention the hinged pair of side walls of the foldable plastic slider are ultrasonically welded to the support member.

In another aspect of the invention the side walls of the foldable plastic slider and the opposite sides of the support member include interlocking structure to interlock the side walls with the support member.

It is a further object of the invention to provide a method of assembly of a foldable plastic slider comprising a body having a depending separator finger and a pair of foldable wings, with a profiled plastic reclosable fastener particularly suited for thermoplastic bags for opening and closing the fastener comprising the steps of positioning a plastic bag having a plastic reclosable fastener along the top edges of the front and back faces of the bag to receive the foldable plastic slider in straddling relation, the fastener comprising a first interlocking element having a female fastener profile attached to one of the faces of the bag and a second interlocking element having a male fastener profile attached to the other face of the bag, inserting the plastic separator finger between the first and second interlocking elements, and forming the slider in straddling relation around the male and female fastener profiles at the top edges of the bag by folding the pair of wings downwardly toward the plastic separator finger and against the opposite sides of the body, and securing the pair of wings to the opposite sides of the body in fixed relation with the separator finger to form a pair of side walls for the slider whereby movement of the slider in one direction opens the fastener elements and movement in the opposite direction recloses the fastener elements.

Other objects and advantages of the invention will become apparent from the following detailed description invention taken in conjunction with the accompanying drawings.

PREFERRED EMBODIMENT OF THE INVENTION

Figure 1:
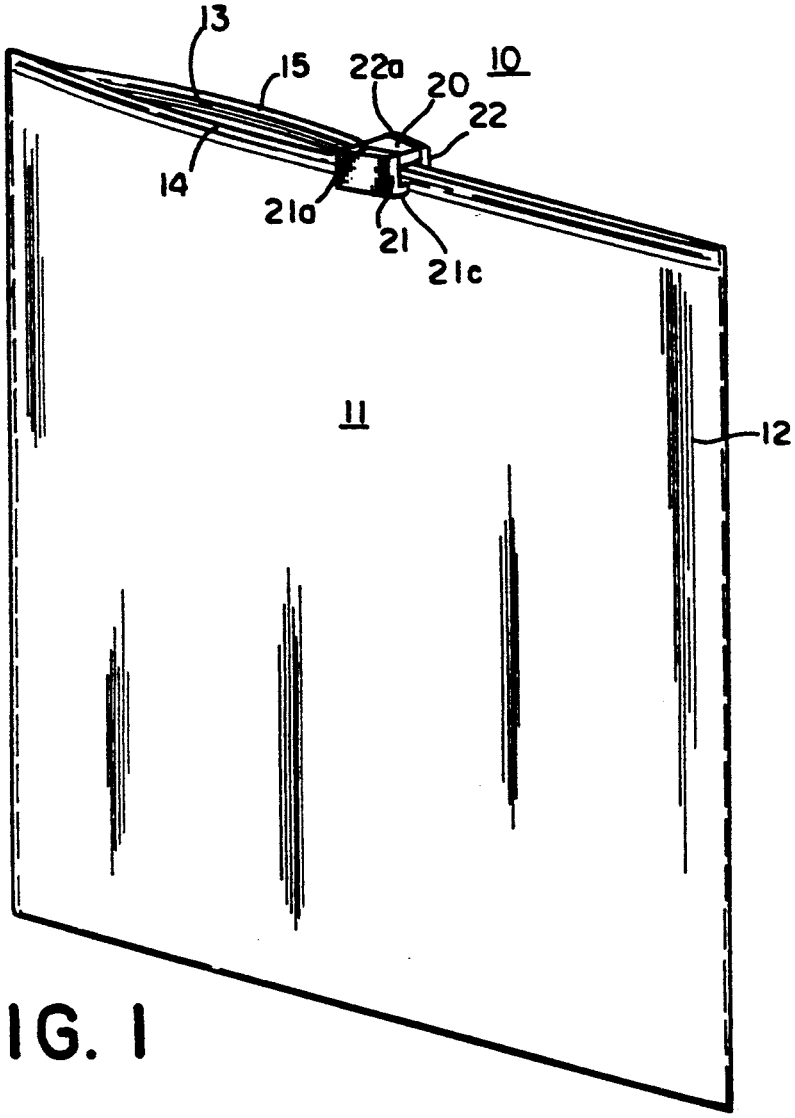
FIG. 1 is a perspective view of a thermoplastic bag or the like having a foldable plastic slider embodying the present invention assembled on the separable fastener means at the top edge of the bag in accordance with the method embodying the present invention.

Referring to FIG. 1, there is illustrated a foldable plastic slider 10 for a profiled plastic reclosable fastener embodying the present invention. The slider 10 is particularly suited for thermoplastic bags and the like and has been illustrated in FIG. 1 in connection with the thermoplastic bag 11. The bag 11 may be made from any suitable thermoplastic film such for example as polyethylene, polypropylene or equivalent material. The bag 11 is formed by a pair of flexible plastic sheets 12 and 13 having a top edge with separable fastener means at the top edge extending along the length thereof having reclosable interlocking rib and groove profile elements 15 and 14 on the facing surfaces thereof. As pointed out above, in the manufacture of thermoplastic film bags, a pair of male and female fastener elements 15 and 14 extend along the mouth of the bag and these (interlocking rib and groove profiles) elements are adapted to be secured in any suitable manner to the flexible walls of the thermoplastic film bags. These elements may be integral marginal portions of such walls or they may be extruded separately and thereof attached to the walls along the mouth of the bag as well known in the art. The elements 15 and 14 are attached to the respective walls of the bags on opposite sides of the bags as disclosed in FIGS. 1–8. The cross-sectional shapes of the interlocking male and female elements having the rib and groove profiles 15 and 14 and the slider 10 are the subject of my invention claimed in the aforesaid related application entitled "Rolling Action Zipper Profile and Slider Thereof" Ser. No. 490,110, now U.S. Pat. No. 5,007,143 filed concurrently herewith and incorporated herein by reference thereto. The manner of attaching the elements 14, 15 to the respective walls of the bag is well known in the art and does not form part of the present invention.

Figure 2:
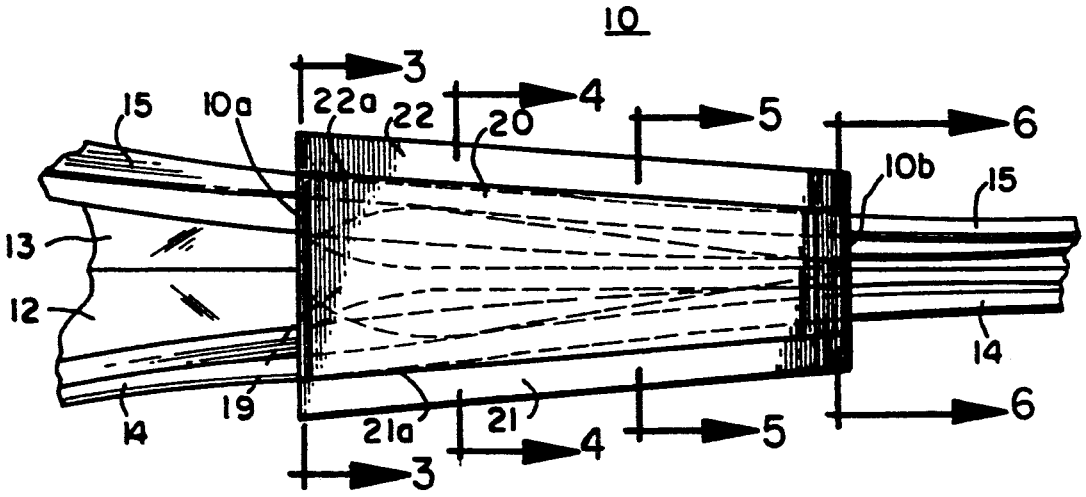
FIG. 2 is a fractional top plan view on enlarged scale of the slider shown in FIG. 1.
Figure 8:
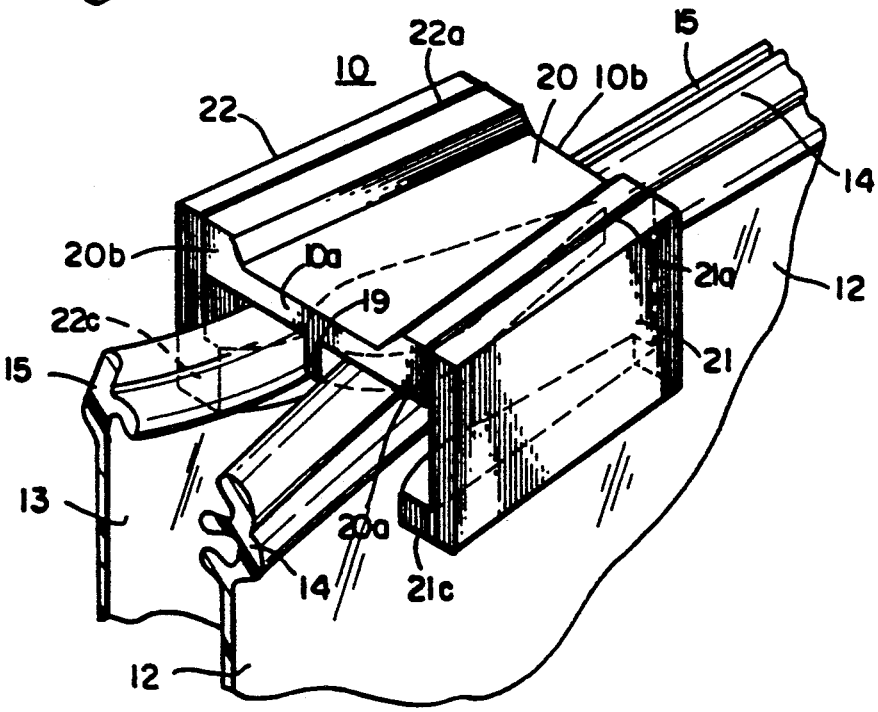
FIG. 8 is a perspective view of a foldable plastic slider of FIGS. 1, 2 and 7 assembled according to FIG. 7.

As may be seen in FIGS. 1, 2 and 8 the slider 10 straddles the reclosable fastener elements 14, 15 at the top of the bag 11 and is adapted for opening or closing the reclosable fastener elements. The novel slider 10 is formed from a single piece of molded plastic comprising a wedge-shaped separator finger 19 and interlocking complimentary structure for moving along the fastener. The slider 10 may be molded from any suitable plastic such for example as nylon, polypropylene, polystyrene, Delrin or ABS. In the preferred embodiment the complimentary structure comprises an inverted U-shaped member including a transverse support member or body 20 from which the wedge-shaped separator finger 19 depends. The body 20 is adapted to move along the top edges of the fastener elements 14 and 15 and includes a pair of hinged "wings" or side walls 21 and 22 that can be folded down into their final position. The wings 21 and 22 are hinged to the main slider body 20 by means of hinge structure **21*a* and 22*a*. It will be noted that the hinge structure 21*a* and 22*a* is located on the opposite sides 20*a*, 20*b* of the main slider body 20 at the top thereof. This is to be contrasted with the location of the hinge structure at the bottom of the support member or body in the co-pending related application Ser. No. 490,108, now U.S. Pat. No. 5,010,627 referred to above. The importance of this location of the hinge structure in the present application will be hereinafter explained. The hinge structure 21*a* and 22*a* is a relatively thin section of the plastic material as compared to the wall thicknesses of the wings 21 and 22 and the flexibility of the plastic material make possible the use of the integral hinged structure 21***a* and 22*a* which is sometimes referred to as "living" hinge.

Figure 7:
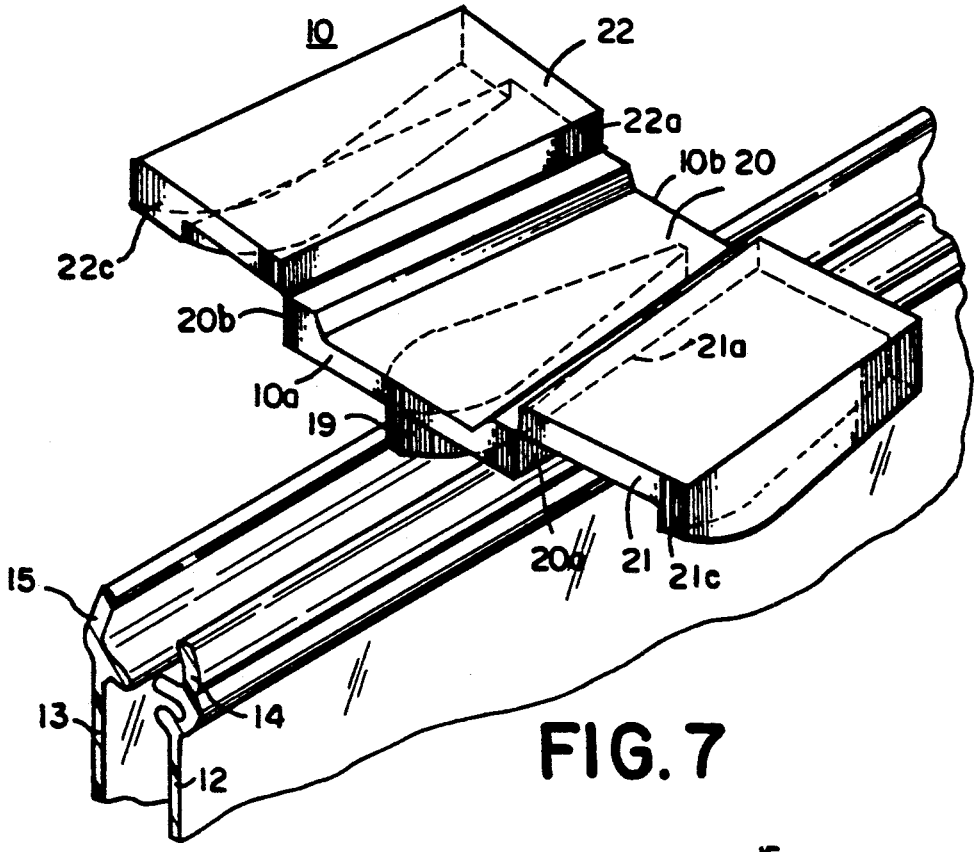
FIG. 7 is a perspective view showing the foldable slider in open position and illustrating the method of assembling a foldable plastic slider of FIGS. 1 and 2 with the profiled plastic reclosable fastener in accordance with the present invention.
Figure 9:
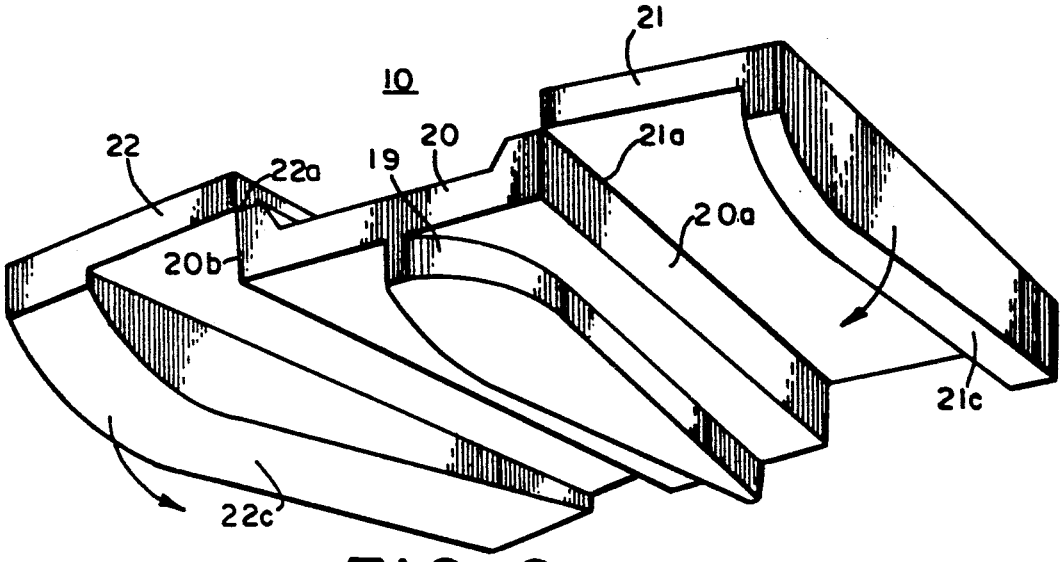
FIG. 9 is an enlarged perspective view of the foldable plastic slider in open position.

When the Wings 21 and 22 are folded down to their final side wall position from the wing position in FIGS. 7 and 9 to the side wall position shown in FIG. 8, the side walls 21 and 22 are held in fixed position by ultrasonically welding the side walls to the opposite edges 20*a*, 20*b* of the main slider body 11. Thus it will be seen that in the present invention there has been eliminated the necessity of the depending legs disclosed in the copending application Ser. No. 490,108, now U.S. Pat. No. 5,010,627. The present invention permits the use of a smaller slider and a construction which is more easily molded in a simple 2-piece mold and thus reduces the cost of manufacture of the slider.

As may be seen in FIGS. 2–6 the foldable depending side walls 21 and 22 extend from an opening end 10*a* of the slider 10 to a closing end 10*b*. The side walls 21 and 22 are spaced wider apart at the opening end 10*a* of the slider 10, FIGS. 2 and 3, to permit separation of the rib and groove elements 15 and 14 and are spaced sufficiently close together at the closing end 1O*b* of the slider, FIG. 6, to press the rib and groove elements 14 and 15 into interlocking relationship as the slider 10 is moved in a fastener closing direction. The side walls 21 and 22 at their lower ends are provided with inwardly extending shoulder structure 21*c* and 22*c*, FIGS. 4–6, for engaging the bottom of the fastener comprising the rib and groove elements 15 and 14 to prevent the slider 10 from being lifted off the top edges of the fastener while the slider straddles the fastener as shown in FIGS. 2 and 8.

Figure 3:
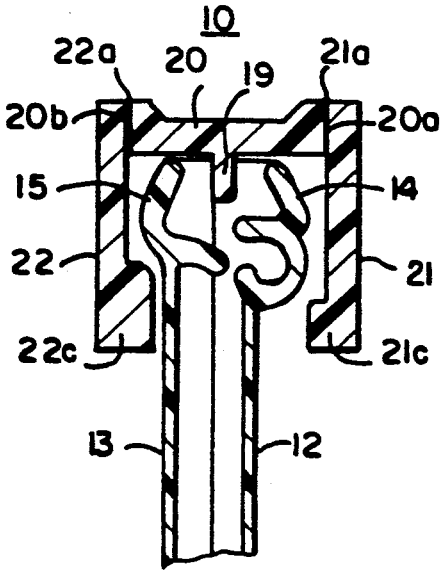
FIG. 3 is a sectional view taken along the lines 3—3 in FIG. 2.
Figure 4:
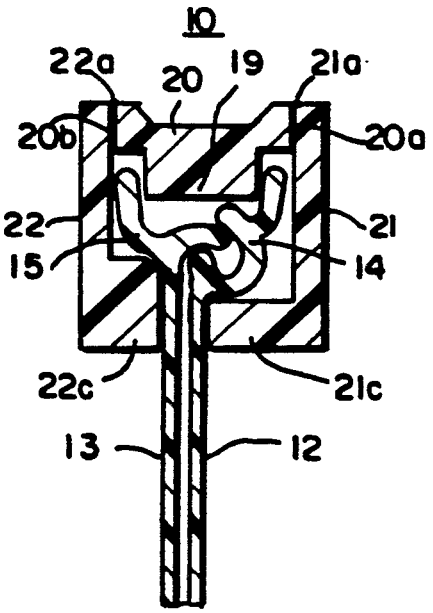
FIG. 4 is a sectional view taken along the lines 4—4 in FIG. 2.
Figure 5:
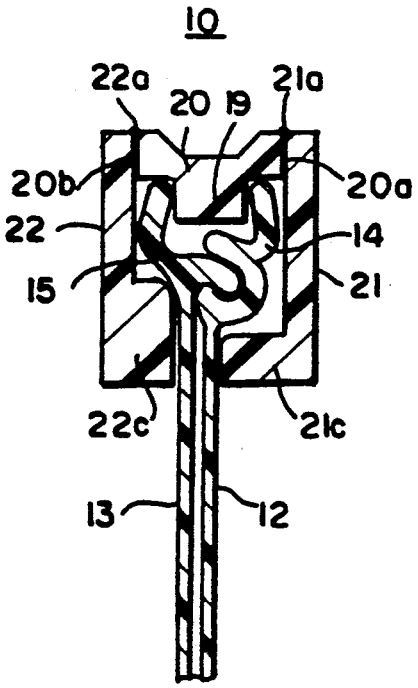
FIG. 5 is a sectional view taken along the lines 5—5 in FIG. 2.
Figure 6:
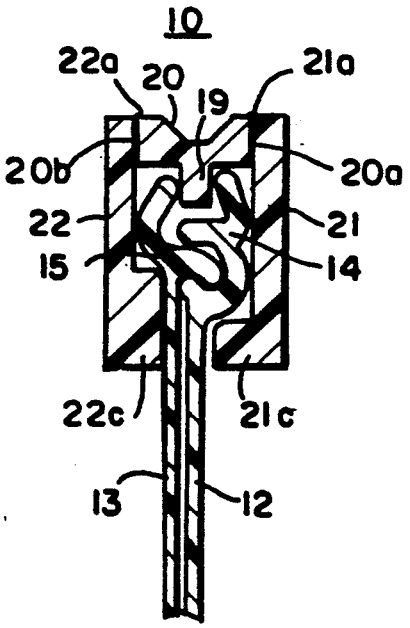
FIG. 6 is a sectional view taken along the lines 6—6 in FIG. 2.

The depending plastic separator finger 19 which extends between the side walls 21 and 22 is wider adjacent the opening end 10*a* of the slider 10 for separating the rib and groove elements 15 and 14 as the slider 10 is moved in the fastener opening direction, FIGS. 2–4. The tip of the separator finger 19 is tapered at the opening end 10*a*, FIGS. 2 and 8, so that the slider 10 may be moved easily in the fastener closing direction. Referring to FIGS. 7 and 8 there is illustrated the method of assembling a foldable plastic slider 10 with the profile plastic reclosable fastener of a thermoplastic bag formed by the pair of flexible plastic sheets 12 and 13 having a top edge with separable fastener means at the top edge extending along the length thereof, having reclosable interlocking rib and groove profile elements 15 and 14 on the facing surfaces thereof. The interlocking rib and groove profile elements 15 and 14 on the facing surface are placed in alignment so that they can be joined as indicated at the right hand end of FIGS. 2 and 8. The foldable slider 10 with the wings 21 and 22 in the open position, FIG. 9, is positioned above the profile elements 14 and 15 as shown in FIG. 7. When the elements 14 and 15 are joined as indicated at the right hand end of FIG. 8, the depending finger 19 is inserted between the top edges of the elements 14 and 15 as shown in FIG. 8. The body 20 of the slider 10 then rests on the top of the elements 14 and 15. The wings 21 and 22 are then folded down, as indicated by the arrows in FIG. 9, at the hinge structure 21*a* and 22*a* located at the top of the slider body 20 so that the wings 21 and 22 are in their folded side wall position against the edges 20*a*, 20*b* shown in FIG. 8. When the side walls 21 and 22 are in the folded position shown in FIG. 8 they are ultrasonically welded to the opposing edges or sides 20*a*, 20*b* of the main body structure 20 thus preventing the side walls 21 and 22 from being rotated upwardly around the hinge structure 21*a* and 22*a*. In this assembled position the shoulders 21*c* and 22*c* on the side walls 21 and 22 are positioned beneath the bottom of the fastener elements 14 and 15, FIGS. 4, 5 and 8, to prevent the slider 10 from being lifted off the top edges of the fastener.

Since the side walls 21 and 22 of the foldable slider 10 are integral with the body portion 20, this provides for ease in assembly as distinguished from multiple part sliders. It also provides for ease in manufacture and molding as pointed out above. Also since the slider is made from plastic material it can be used on a food bag in a microwave whereas a metal slider cannot. While the preferred form of the invention has been described in connection with a living hinge other plastics which are not suitable for making a living hinge can be used. Thus more brittle plastics can be used. It is only necessary that the side walls be folded down once and welded into place since the slider is not removed from the reclosable fastener elements once it is assembled.

Figure 10:
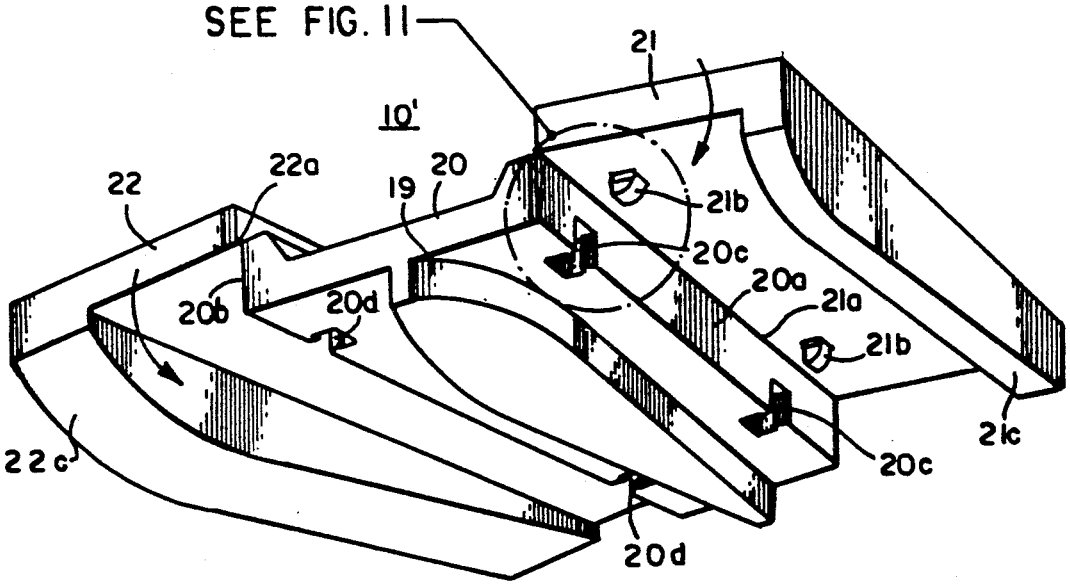
FIG. 10 is a perspective view of a modification of a foldable plastic slider in accordance with the present invention.
Figure 11:
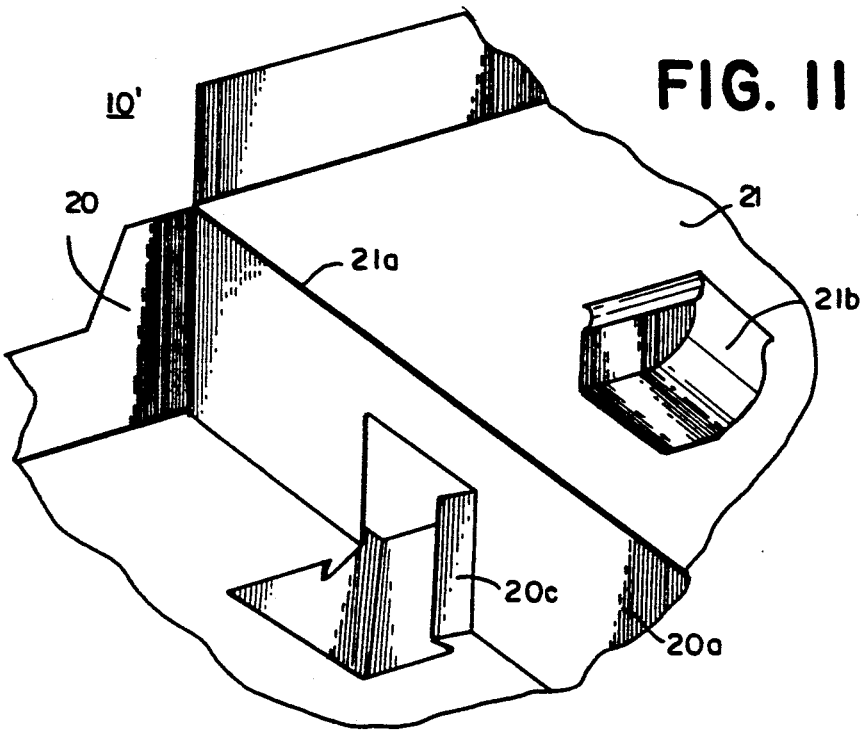
FIG. 11 is a fractional view on enlarged scale of a portion of the slider illustrated in FIG. 10.

While a preferred form of the invention as described and illustrated in connection with FIGS. 1–9 provides for ultrasonically welding the side walls 21 and 22 to the edges 20*a*, 20*b* of the body member 20 it is to be understood that a modified securing arrangement can be utilized within the scope of this invention. For example in FIG. 10 a modification 10' of the slider 10 has been illustrated wherein the pair of hinged "wings" or side walls 21 and 22 are held in place against the slider body 20 by means of one or more lugs on the wings which latch into a mating socket on the slider body. It will be noted that the slide 10' illustrated in FIG. 10 is identical with the slider 10 illustrated in FIG. 9 with the exception of the lugs on the wings which latch into mating sockets on the body member 20. As may be seen in FIG. 10 the lugs 21*b*, 21*b* on the wing 21 latch into the mating sockets 20*c*, 20*c* on the body 20. An enlargement of one of the lugs 21*b* and mating socket 20*c* on the main slider body 20 is illustrated in FIG. 11. It is to be understood that the other wing or side wall 22 likewise is provided with lugs, not shown, which mate with sockets 20*d*, 20*d*, FIG. 10 which are similar to the mating lugs 21*b* and sockets 20*c* previously described. For cost consideration, it is desirable that the slider be molded using a simple 2-piece mold, so it cannot have undercuts. The lug and recess can have a slight taper, so once they are pressed in place, they will be difficult to separate. As an alternative configuration for improved holding power, the recess can be tapered in a horizontal direction and the lug can have a very slight undercut as illustrated in FIG. 11. If the undercut on the lug is small, it is possible to press the molded part out of the mold, deflecting the lug enough to get past the mold.

Figure 12:
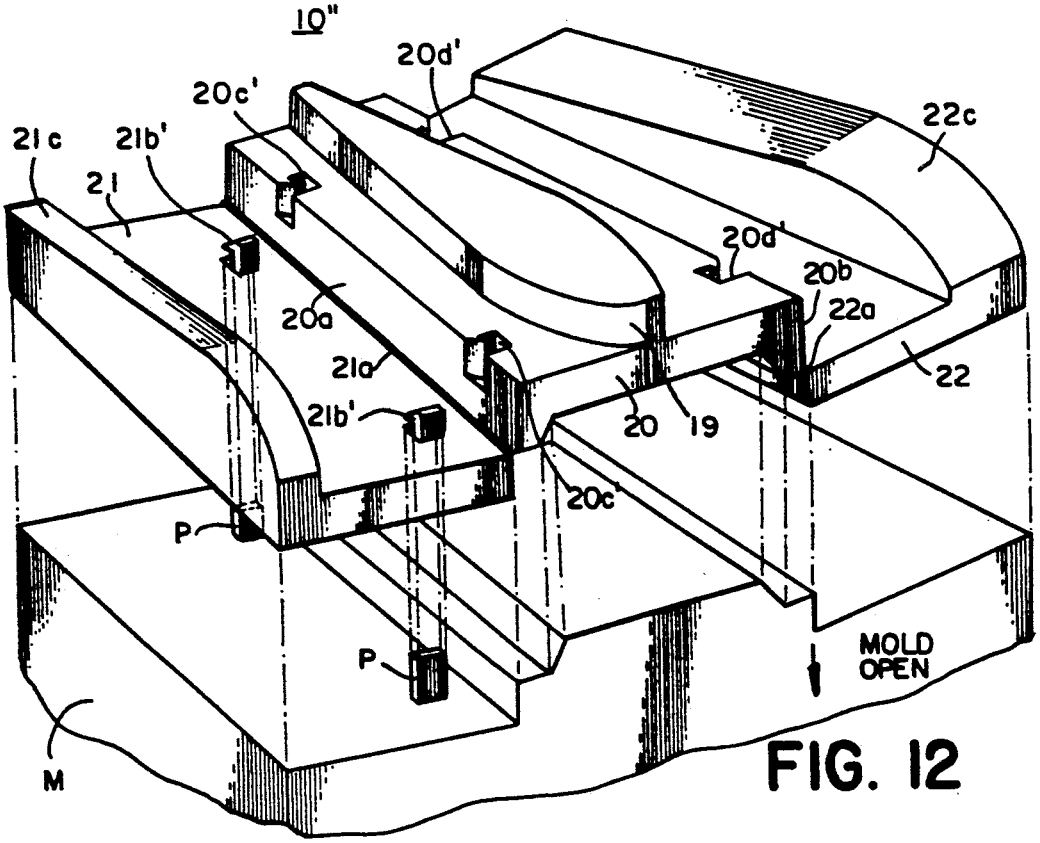
FIG. 12 is a perspective view of another modification of a foldable plastic slider in accordance with the present invention.

An alternative latching arrangement is illustrated in FIG. 12. As pointed out above for cost considerations, it is essential that the slider be moldable using a simple 2-piece mold. Normally, a mold of this type does not allow for severe undercuts as desired on the lug in the slider design. By incorporating a pin P in the mold M extending through the wings 21 and 22 from the side opposite the lugs, an undercut may be created with a simple mold. The resulting hole in the wing 21 created by the pin P does not interfere with the function of the slider 10''. As may be seen in FIG. 12, the undercut lug 21*b'* latches into the mating profiled socket 20*c'* in the body 20 when the wing 21 is hinged closed. Similar pins are used to make lugs in wing 22 to latch with the mating sockets 20*d'* in the edge 20*b* of body 20. As illustrated in FIG. 12 the mold M is opened by moving it in a downward direction.

The method of assembly disclosed herein is particularly suited for the manufacture of thermoplastic bags on a production line where the bags move sequentially along the production line. The foldable plastic slider may be assembled with the bags prior to the formation of the side seals or after the formation of the side seals and severing of the individual bags as desired. In any event the foldable plastic slider is assembled with a reclosable fastener structure at periodic intervals along the plastic profiles with one fastener for each bag to be manufactured.

While the preferred embodiment of the invention has been described and illustrated in connection with interlocking rib and groove profiles of the shapes disclosed in my aforesaid related application Ser. No. 490,110, now U.S. Pat. No. 5,007,143 it is to be understood that the novel foldable plastic slider of the present invention is also applicable to profiled plastic reclosable fasteners or zippers of the conventional configuration such as shown in U.S. Pat. No. 3,660,875 and in my aforesaid related applications Ser. No. 490,109,now U.S. Pat. No. 5,007,142. In conventional profile plastic zippers the separator tab or finger is inserted directly between the rib and groove portions of the interlocking elements rather than above the rib and groove portions as disclosed herein.

While preferred embodiments of the invention have been described and illustrated, it is to be understood that further modifications thereof may be made within the scope of the appended claims without departing from the spirit of the invention.

What is claimed is:

1. A foldable plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking male and female elements having rib and groove profiles on the respective sheets, the straddling slider for closing or opening the reclosable fastener elements comprising a separator finger and interlocking complementary structure formed from plastic for moving along the fastener, the complementary structure comprising a transverse support member having the separator finger depending therefrom, a pair of side walls hinged to the opposite sides of said support member at the top thereof and foldable relative to said separator finger and means for interlocking said opposite sides of said support member to said side walls, said side walls extending from an opening end of the slider to the closing end, the side walls being spaced wider apart at the opening end to permit separation of the rib and groove elements by the separator finger extending between the side walls at the opening end, the side walls being spaced sufficiently close together at the closing end to press the rib and groove elements into interlocking relationship as the slider is moved in a fastener closing direction, at least one of said separator finger and said side walls having shoulder structure on the bottom thereof for cooperating with the bottom of the fastener to prevent the slider from being lifted off the top edge of the fastener while the slider straddles the fastener.

2. A plastic slider according to claim 1 wherein said side walls and said opposite side of said support member include interlocking structure to interlock said side walls with said support member.

3. A plastic slider according to claim 1 wherein said hinged pair of side walls are welded to said support member.

4. A plastic slider according to claim 1 wherein said separator finger is wedge-shaped.

5. A foldable plastic slider for straddling relation with a profiled plastic reclosable fastener particularly suited for thermoplastic bags and the like formed by a pair of flexible plastic sheets having a top edge with separable fastener means extending along the length thereof comprising reclosable interlocking male and female elements having rib and groove profiles on the respective sheets, the straddling slider for closing or opening the reclosable fastener elements comprising a separator finger and interlocking complementary structure formed from plastic for moving along the fastener, the comlementary structure comprising a transverse support member having the separator finger depending therefrom, a pair of side walls connected to the opposite sides of said support member and depending therefrom, at least one of said side walls being hinged to said support member at the top thereof and foldable relative to said separator finger, and means for interlocking said opposite sides of said support member to said side walls, said side walls extending from an opening end of the slider to the closing end, the side walls being spaced wider apart at the opening end to permit separation of the rib and groove elements by the separator finger extending between the side walls at the opening end, the side walls being spaced sufficiently close together at the closing end to press the rib and groove elements into interlocking relationship as the slider is moved in a fastener closing direction, at least one of said separator finger and said side walls having shoulder structure on the bottom thereof for cooperating with the bottom of the fastener to prevent the slider form being lifted off the top edge of the fastener while the slider straddles the fastener.

6. A plastic slider according to claim 5 wherein each said side wall hinged to said support member includes interlocking structure to interlock each hinged side wall with said support member.

7. A plastic slider according to claim 5 wherein each said hinged side wall is welded to said support member.

8. A plastic slider according to claim 5 wherein said separator finger is wedge-shaped.

9. A plastic slider according to claim 5 wherein said shoulder structure is on the bottom of said at least one side wall hinged to said support member.

* * * * *